US006571965B1

(12) United States Patent
Beck et al.

(10) Patent No.: US 6,571,965 B1
(45) Date of Patent: Jun. 3, 2003

(54) DISHWASHER RACK WITH PIVOTABLE FENCES

(75) Inventors: Casey Brian Arthur Beck, Paw Paw; Mark H. Nelson, Berrien Springs; John Irven Smith, Coloma; Jeffrey Ray Taylor, Stevensville, all of MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/548,094

(22) Filed: Apr. 12, 2000

(51) Int. Cl.[7] ..... A47G 19/08
(52) U.S. Cl. ..... 211/41.8
(58) Field of Search ..... 211/41.8, 41.9, 211/41.1, 41.5, 41.6, 181.1

(56) References Cited

U.S. PATENT DOCUMENTS

| | | | | |
|---|---|---|---|---|
| 3,269,548 A | | 8/1966 | Geiger | |
| 3,402,975 A | | 9/1968 | Smith | |
| 3,612,285 A | * | 10/1971 | Mason | 211/41.8 |
| 3,752,322 A | | 8/1973 | Fiocca | |
| 4,046,261 A | | 9/1977 | Yake | 211/41 |
| 4,183,437 A | | 1/1980 | Crawford et al. | 211/41 |
| 4,606,464 A | | 8/1986 | Jordan et al. | 211/41 |
| 5,109,990 A | | 5/1992 | Murphy | 211/41 |
| 5,158,185 A | | 10/1992 | Michael et al. | 211/41 |
| 5,205,419 A | * | 4/1993 | Purtilo | 211/41.8 |
| 5,344,029 A | | 9/1994 | Oghia et al. | 211/41 |
| 5,351,837 A | | 10/1994 | Smith | 211/41 |
| 5,497,890 A | | 3/1996 | Clark | 211/41 |
| 5,649,630 A | | 7/1997 | Remmler | 211/41.8 |

* cited by examiner

*Primary Examiner*—Alvin Chin-Shue
*Assistant Examiner*—Sarah Purol
(74) *Attorney, Agent, or Firm*—Joel M. Van Winkle; Robert O. Rice; Stephen Krefman

(57) ABSTRACT

A dishwasher rack which includes a basket supporting a plurality of fences rotatably about a common axis. The basket has a plurality of wires forming a bottom wall, a pair of side walls and a front and back wall. The bottom wall has a plurality of upwardly oriented tines connected to and extending from the bottom wall in a first area and further has an open area without upwardly oriented tines. A first fence is provided having an axle wire and a plurality of support wires. The axle wire is rotatably supported adjacent the bottom wall such that the first fence may be rotated between a front position and a back position. A second fence is provided having a connection wire and a plurality of support wires. The connection wire is rotatably connected to axle wire such that the second fence may rotate about the axle wire between a front position and a back position. The first fence and second fence may be rotated to the first position such that the support wires of the first fence and the support wires of the second fence form an upstanding array for supporting dishes. Alternatively, one or both of the first fence and second fence may be rotated to the back position.

12 Claims, 7 Drawing Sheets

DISHWASHER RACK WITH PIVOTABLE FENCES

BACKGROUND OF THE INVENTION

1. Field of the Invention

The present invention generally relates to racking systems or dishracks for dishwashing appliances and in particular to dishwasher racks having pivotable fence assemblies which enhance the loading flexibility of the racks.

2. Description of the Related Art

In the design of dishwasher racks it has generally been industry practice to design racks with dish support members arranged for loading "standard" dish sizes. It is, however, likely that most households will include some "non-standard" dishes as well as various odd shaped cooking utensils which will not load properly in a dishwasher rack designed for only "standard" dishes. To alleviate the problem presented by "non-standard" dishes and other cooking utensils, several rack designs have evolved which have included movable or adjustable portions.

Geiger et al, in U.S. Pat. No. 3,269,548 issued Aug. 30, 1966, teach a rack system which is vertically adjustable within the dishwasher to accommodate large articles. The upper rack also includes several pivoted divider members. Each of the pivoted divider members is formed of wire members and is supported on the upper rack by a pair of hinge clips secured to the base of the wire rack for supporting the ends of the pivoted divider members. A separate sheet metal detent member is positioned at the end of the rack for holding the pivoted divider members in the upright position.

Smith, in U.S. Pat. No. 3,402,975 issued Sep. 24, 1968, teaches a top loading dishwasher having two levels of dishracks. Access to the lower dishrack is attained by utilizing a horizontally movable rack in cooperation with a hinged shelf which is pivotally supported between a pair of the dishwasher side walls at one end and by a portion of the movable rack at the other end. The hinged shelf includes a pair of pivotal divider assemblies each of which may be maintained in an upright posture by a detent assembly at one end of the divider assembly.

Fiocca et al, in U.S. Pat. No. 3,752,322 issued Aug. 14, 1973, teach a dishwasher rack construction in which a pivoted element can be retained in one of a plurality of intermediate positions by an arcuate toothed member located at the front of the rack.

Yake, in U.S. Pat. No. 4,046,261 issued Sep. 6, 1977, discloses a dishwasher rack which includes a pair of brackets fixed to the bottom of the rack and having molded slots and retainers for receiving a plurality of fences in a plurality of positions. These fences are either vertically mounted between the pair of brackets or are removed from the dishwasher rack. There is no pivotal movement of individual fences but only selective use of these fences for adjusting the distance between adjacent fences and between the rack side walls.

Prior patents show that considerable effort has been focused on the development of dishwasher racks and on the development of dishwasher racks which include flexible or variable spacing arrangements for accommodating a variety of dish loads.

SUMMARY OF THE INVENTION

It is therefore an object of the instant invention to provide an improved dishwasher rack with pivotable fences.

It is a further object of the instant invention to provide a dishwasher rack with a plurality of fences which are pivoted about a common axis.

It is a still further object of the instant invention to provide a dishwasher rack with a pivotable fence wherein the pivotable fence is positively secured to the dishwasher rack in a unique and simple manner.

According to the present invention, the foregoing and other objects are attained a dishwasher rack which includes a basket having a plurality of wires forming a bottom wall, a pair of side walls and a front and back wall. The bottom wall has a plurality of upwardly oriented tines connected to and extending from the bottom wall in a first area and further has an open area without upwardly oriented tines. A first fence is provided having an axle wire and a plurality of support wires. The axle wire is rotatably supported adjacent the bottom wall such that the first fence may be rotated between a front position and a back position. A second fence is provided having a connection wire and a plurality of support wires. The connection wire is rotatably connected to axle wire such that the second fence may rotate about the axle wire between a front position and a back position. The first fence and second fence may be rotated to the first position such that the support wires of the first fence and the support wires of the second fence form an upstanding array for supporting dishes. Alternatively, one or both of the first fence and second fence may be rotated to the back position.

The first fence is connected to the basket without the need for additional clips. In particular, the ends of the axle wire are captured in sockets formed by the combination of the basket and wheel assemblies. The second fence may connect to the first fence without the use of clips or, alternatively, with the use of clips.

DESCRIPTION OF THE PREFERRED EMBODIMENTS

Figure 1:
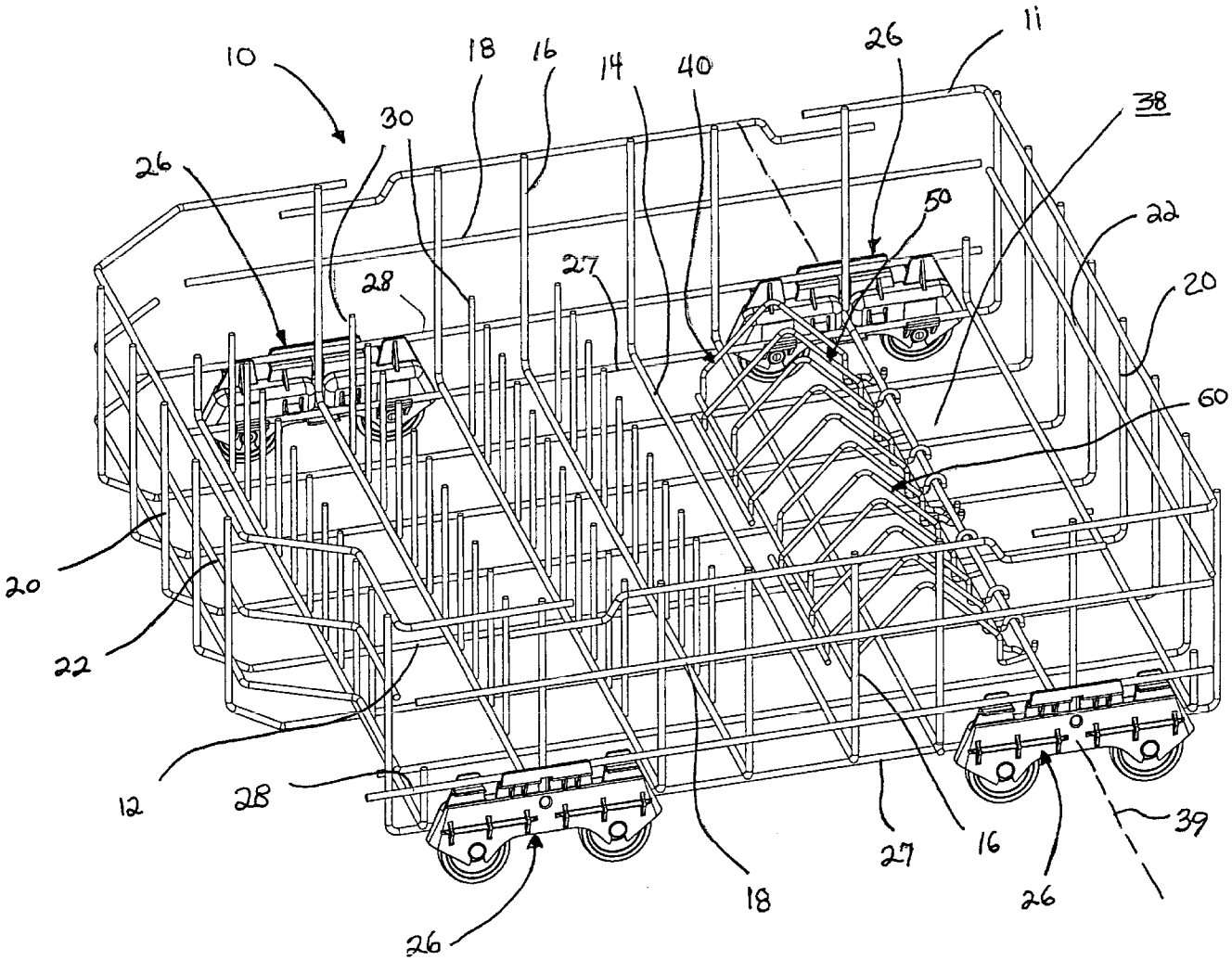
FIG. 1 is a perspective view of the dishwasher rack assembly incorporating one embodiment of the present invention.

Referring now to the drawings, and particularly to FIG. 1, there is shown a lower rack assembly 10 for a domestic dishwasher. The rack assembly 10 includes a basket 11 which is formed from a plurality of wires which form a bottom wall, side walls and a front and back wall and, respectively. More particularly, the bottom wall is formed of spaced apart longitudinal wires 12 joined to spaced apart lateral wires 14. The side walls are formed from the upwardly bent end portions 16 of the lateral wires 14 joined to longitudinal wires 18. The front and back walls are formed from the upwardly bend end portions 20 of the longitudinal wires 12 joined to lateral wires 22. Preferably, the wires 12–22 are welded together into the basket configuration and then coated with a suitable plastic material such as Polyvinylchloride (PVC) or Nylon. While the basket 11 is described above, it is to be understood that the basket may be constructed using different wire configuration or using different materials. For example, the basket 11 may be formed as a plastic structure—either in part or in entirety.

The rack 10 is provided with a plurality of wheel assemblies 26. Preferably there are two wheel assemblies 26 located on each bottom side edge of the basket 11. The wheel assemblies 26 are designed to snap connect to the basket 11—between outermost longitudinal wires 27 and outermost bottom longitudinal wires 28. The wheel assemblies 26 support the basket 11 along tracks (not shown) provided on a dishwasher tub (tub) such that the racks may be rolled in and out of the dishwasher tub.

A network of vertical fingers or tines 30 extend upwardly from the bottom wall and preferably from the transverse wires 14. The tines 30 are typically metal wires made of the same materials as the wires 12–22. The tines serve to keep individual items in the rack separated and in the appropriate orientation to be washed. To this end, the tines 30 may be vertically aligned as shown or may be canted from a strictly vertical position and may include offsets.

It is often desirable to have the tines 30 arrayed throughout a portion of the basket 11, for supporting items such as plates and saucers. It is also sometimes desirable to have part of the basket 11 not include upwardly extending tines 30. For example, tines 30 tend to interfere with optimal loading of heavy bowls or thick pans or casserole dishes. However, when large items such as bowls or thick pans are not being used, it is desirable to have tines or upwardly extending support wires throughout the basket 11 to facilitate the loading of smaller items such as plates and saucers.

To that end, the present invention, in a preferred embodiment, omits the stationary tines 30 from a selected open area 38 near the rear of the rack 10 and provides a main pivotable fence 40 and secondary fences 50 and 60 in the open area 38. The fences 40, 50 and 60 may be pivoted about a single axis 39 such that the open area 38 is provided with a plurality of upstanding wires for supporting smaller items such as plates. The fences may also be pivoted into a position wherein the open area 38 is free of upstanding wires such that large items may be readily supported in the open areas.

Figure 2:
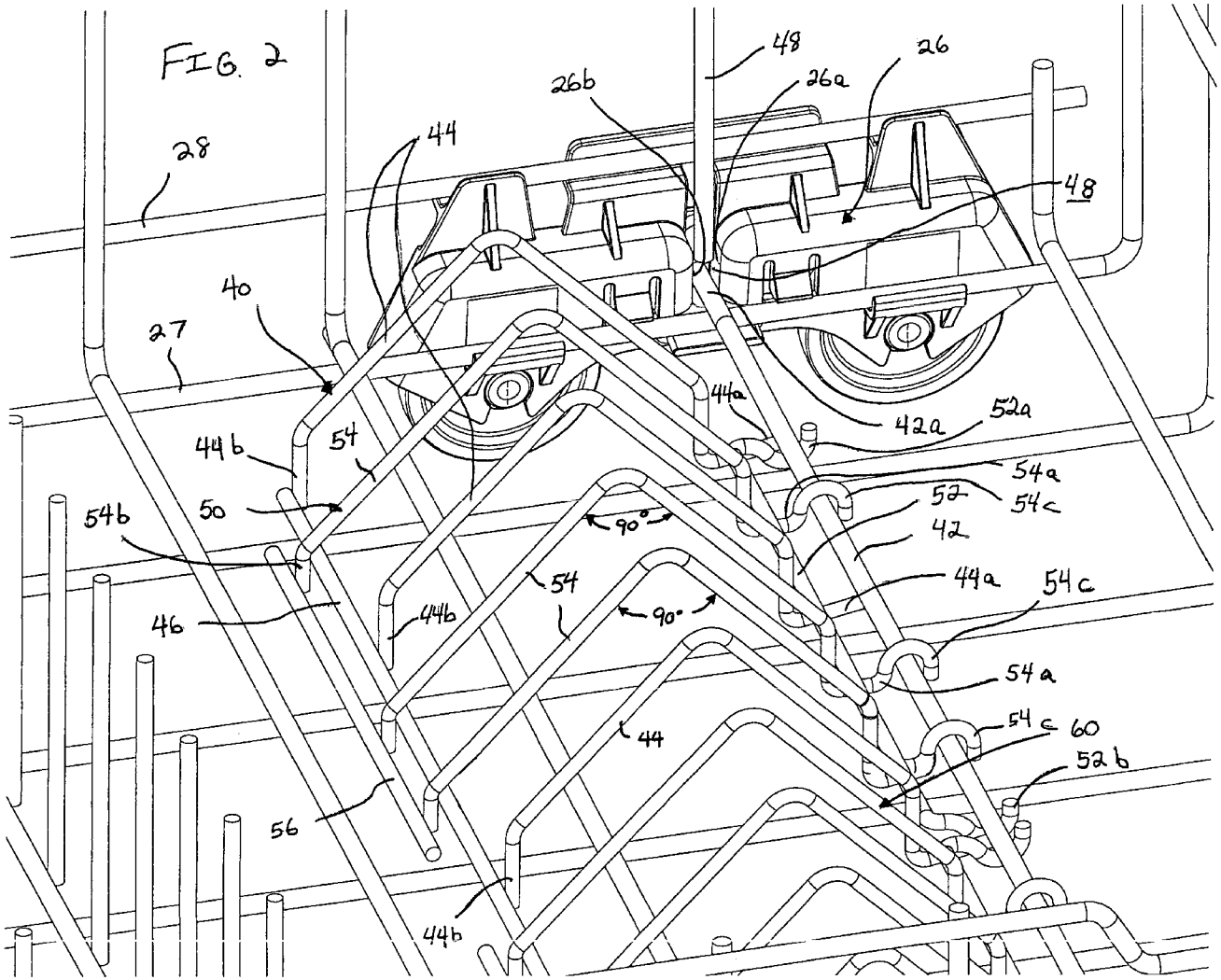
FIG. 2 is an enlarged perspective view of the rear corner of the dishwashing rack of FIG. 1.

Turning now to FIG. 2 in combination with FIG. 1, details of the fences 40, 50 and 60 can be understood. Fence 40 includes an axle wire 42, a plurality of inverted V-shaped support wires 44 and an end wire 46. Each of the support wires 44 include a first end 44*a* connected to the axle wire 42 and a second end 44*b* connected to the end wire 46. The V-shaped support wires 44 are preferably formed having an approximately 90° bend to form the inverted V shape.

The axle wire 42 is rotatably secured to the rack 10 such that the axle wire 42 can rotate with respect to the rack. In particular, the axle wire 42 includes end portions 42*a* wherein each of the end portions 42*a* is captured in a pocket 48 formed between a first wall 26*a* and a second wall 26*b* of the wheel assembly 26, the outermost longitudinal wires 27, and the bottom of the vertical wire 48. To connect the fence 40 to the basket 11, the axle wire 42 is flexed sufficient that the end portions 42*a* may be positioned within the pocket 48, upon release the end portions 42*a* are inserted into the pocket 48. In this manner, by using the wheel assemblies 26, the fence 40 may be rotatably connected to the basket 11 without the need of additional clips or fastening devices.

The fences 50 and 60 are pivotably connected to the axle wire 42. Fences 50 and 60 are substantially similar in construction such that a description of fence 50 is sufficient to understand fence 60. Fence 50 includes a connection wire 52, a plurality of inverted V-shaped support wires 54 and an end wire 56. Each of the support wires 54 include a first end 54*a* connected to the connection wire 52 and a second end 54*b* connected to the end wire 56. The V-shaped support wires 54 are preferably formed having an approximately 90° bend to form the inverted V shape.

The connection wire 52 cooperates with the support wires 54 to rotatably engage the axle wire 42. In particular, the connection wire 52 has a hook element 52*a* and 52*b* formed at each end. The hook members are upwardly orientated such that the hook element 52 passes beneath the axle wire 42. At each first end 54*a* of the support wires 54, a hook element 54*c* is formed. The hook elements 54*c* are downwardly oriented such that the hook elements pass above the axle wire 42. In this manner, the axle wire 42 is captured between the upwardly oriented hook elements 52*a* and the downwardly oriented hook elements 54*c* such that the fence 50 is rotatably connected to the fence 40.

Figure 3:
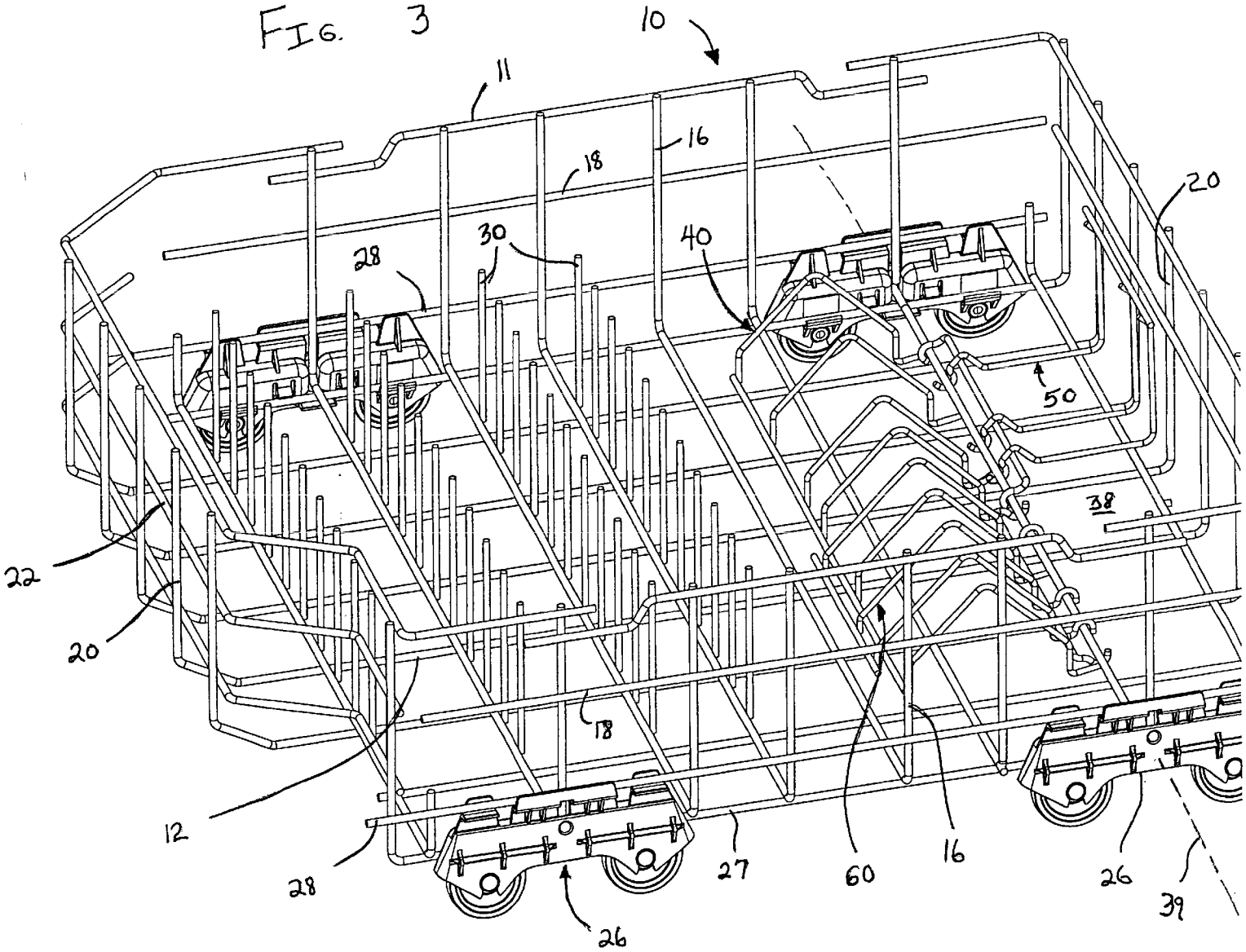
FIG. 3 is a perspective view of the dishwasher rack assembly of FIG. 1, illustrating the first and third fence in a front position and the second fence in a back position.

It can be understood that the fences may be rotated into front position, shown in FIGS. 1 and 2, or may be rotated into a back position, as shown by fence 50 in FIG. 3. In the front position, the support wires 44 and 54 form an array of evenly spaced dishholding spaces. If larger spacing is desired between the support wires, to accommodate larger items such as bowls and/or large pans, for example, the fence 50 may be rotated into a back position as shown in FIG. 3. When one of the fences is in the back position, that fence is positioned along the bottom wall and the rear wall with the approximate 90° bend of the support wires positioned in the rear comer of the basket 11. When just the first fence is in the front position, an array of unevenly spaced dishwashing spaces are provided for supporting larger items such as bowls. If it is desired to have the open space area 38 completely free of support wires or tines, all of the fences 40, 50 and 60 may be rotated into a back position. When rotated into a back position, the fences do not interfere with the open space area 38.

Figure 4:
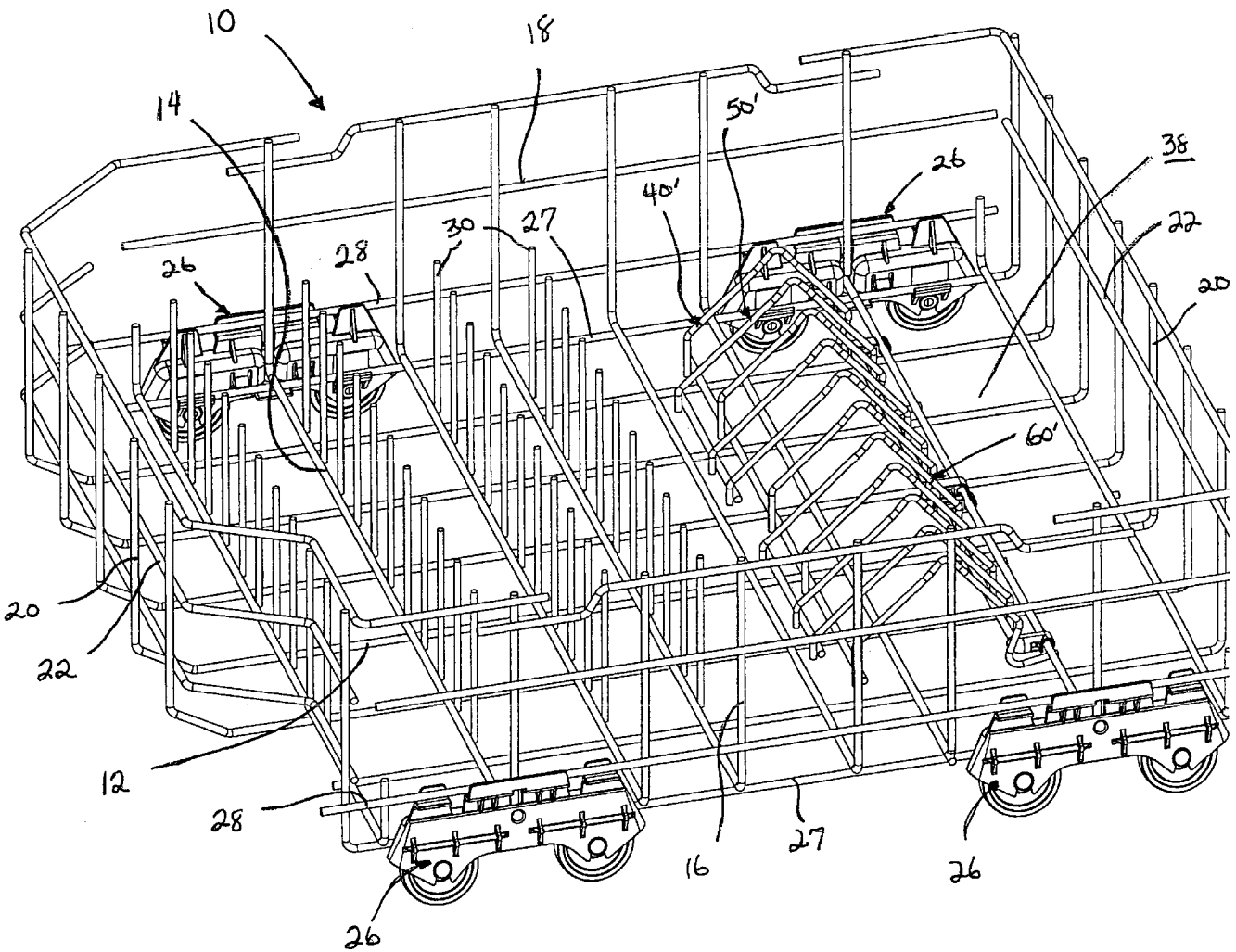
FIG. 4 is a perspective view of the dishwasher rack assembly incorporating a second embodiment of the present invention.
Figure 5:
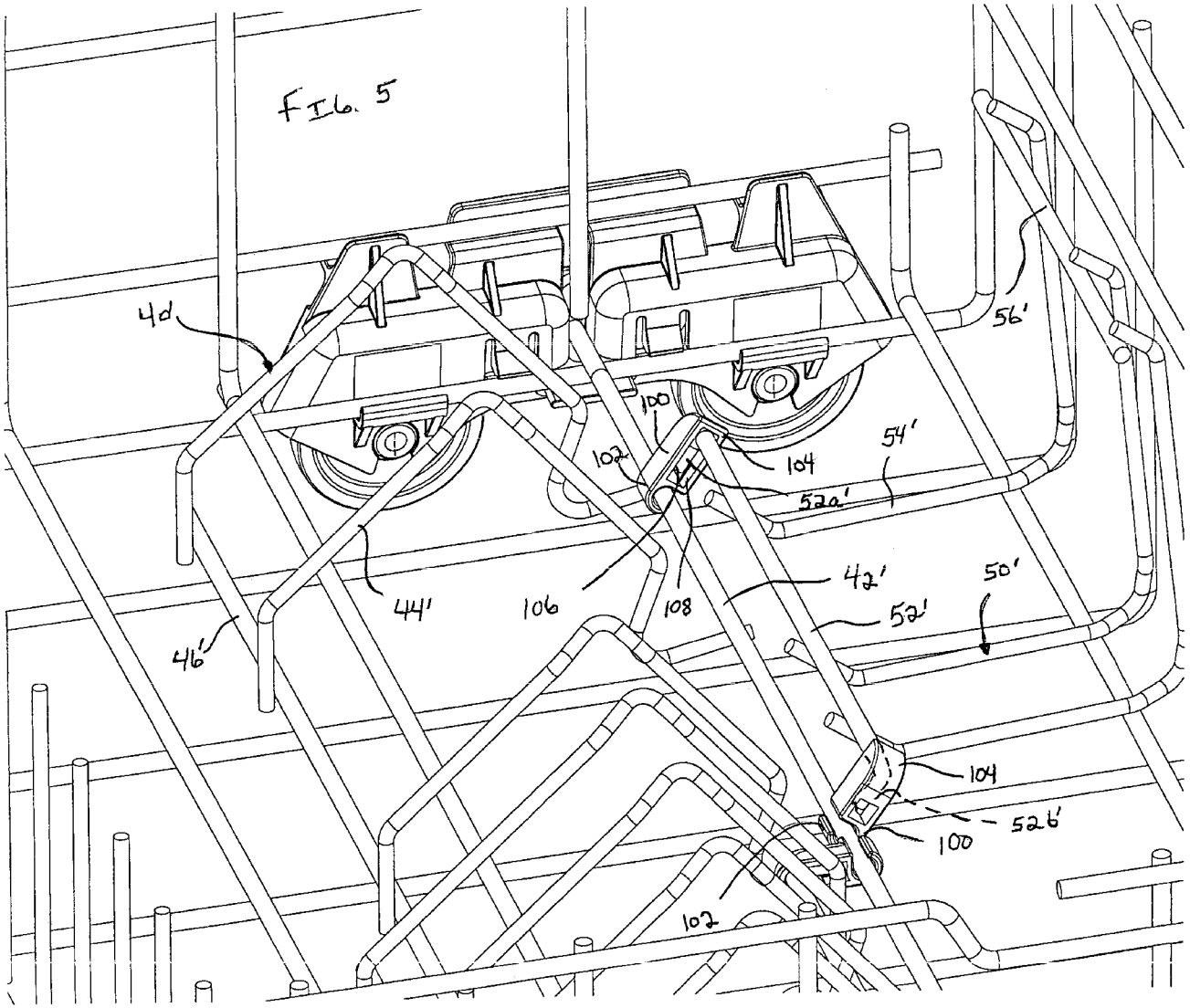
FIG. 5 is an enlarged perspective view of the rear corner of the dishwashing rack of FIG. 4.

FIGS. 4 and 5 illustrated a second embodiment of the present invention. In the second embodiment, the rack assembly 10 is provided with a main fence 40' and a pair of secondary fences 50' and 60' rotatably disposed in the open area 38. The fence 40' is substantially similar to the above described fence 40, and is rotatably connected to the rack 10 through the use of an axle wire 42'. However, in contrast to the first embodiment, fences 50' and 60' are connected to the fence 40' through the use of a plurality of clips 100.

As shown in FIG. 5, the fence 50' includes a connection wire 52', a plurality of V-shaped support wires 54' and an end wire 56'. The connection wire 52' includes a bent over first end 52*a*' and a bent over second end 52*b*'. The bent over ends 52*a*' and 52*b*' extend approximately 90° from the center portion of the connection wire 52'. Each of the clips 100 have a first end 102 which snap connect to the axle wire 46' of the fence 40'. Each of the clips 100 further have a second end 104 which includes an elongated socket 106 which receives one the ends of the connection wire 52'. In this manner, the two clips 100 are used to secure the fence 50 to the axle wire 42'. Likewise, two clips are used to secure the fence 60'.

The elongated sockets 106 are designed to ensure that the connection wire 52' extend from the clip 100 at an fixed 90° angle. Once the ends 52*a*' or 52*b*' are inserted into the elongated socket 106, it is retained the through use of a snap engagement rib 108. Through the engagement of the elongated socket 106 and the bent over end 52*a*' or 52*b*', the connection wire 52' is precluded from swiveling or moving radially with respect to the clip 100. The connection wire 52' is perpendicularly fixed with respect to the clip 100, and as a result, the pair of clips 100 that secure the fence 50' move together when the fence 50' is being rotated about the axle wire 42'.

Figure 6:
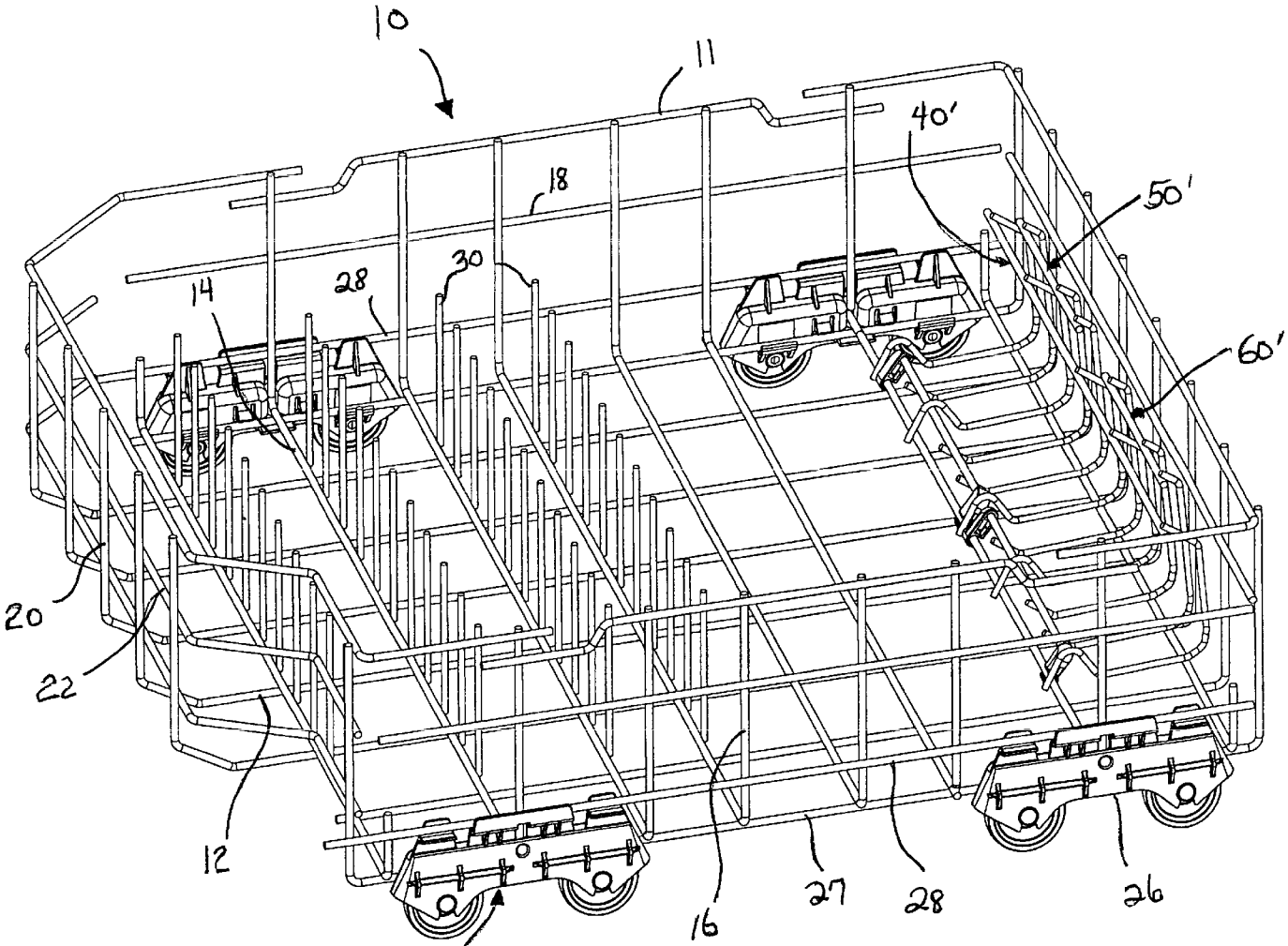
FIG. 6 is a perspective view of the dishwasher rack assembly of FIG. 4, illustrating all of the fences in a back position.
Figure 7:
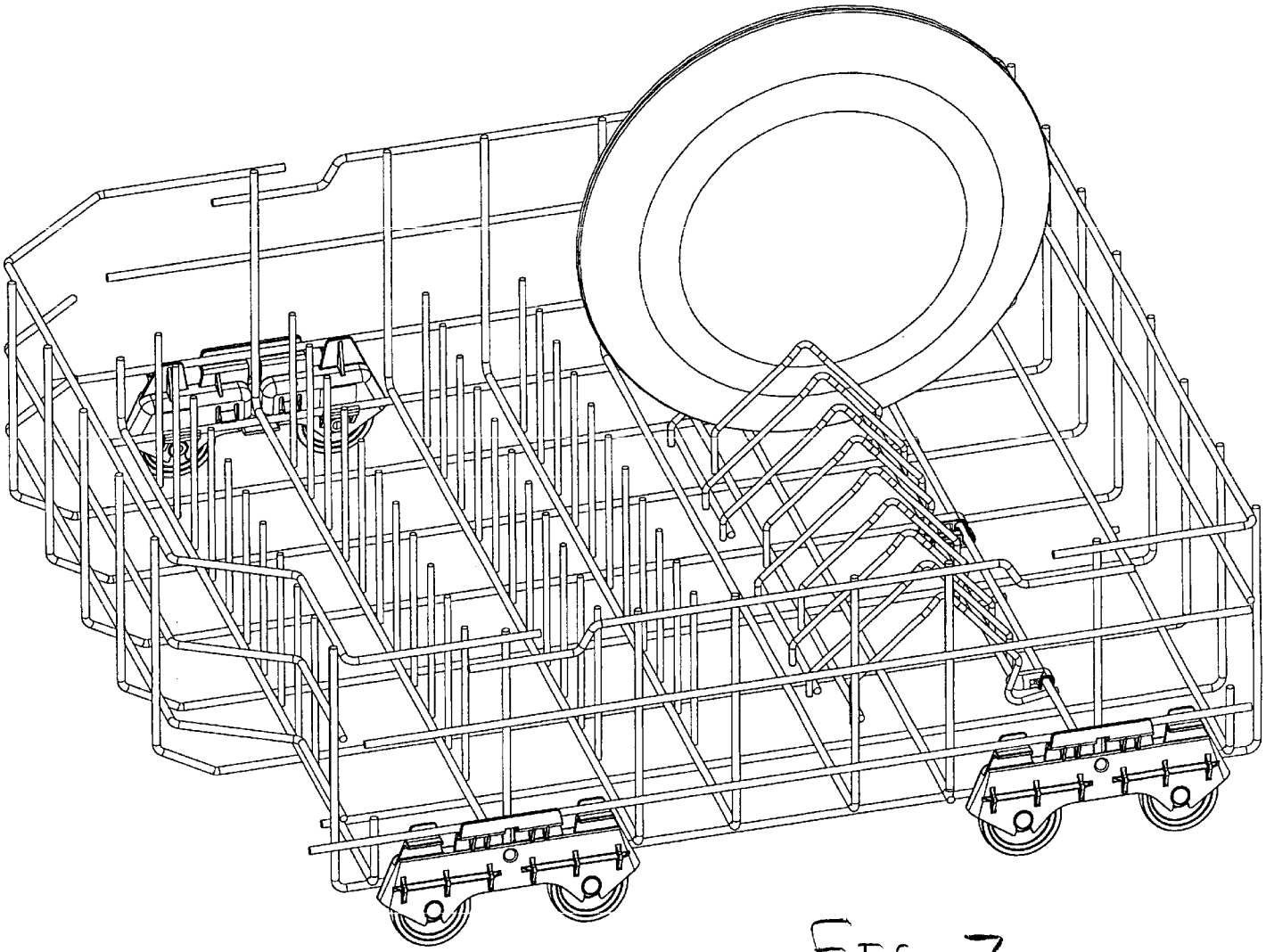
FIG. 7 is a perspective view of the dishwasher rack assembly of FIG. 4, illustrating all of the fences in a front position with a plate being supported by the upstanding array of support wires.

FIG. 6 illustrates the second embodiment with all of the fences 40', 50' and 60' moved into a back position to remove all support wires from the open area 38. FIG. 7 is a perspective view of the second embodiment, illustrating all of the fences in a front position with a plate being supported by the upstanding array of support wires.

While the present invention has been described with reference to the above described embodiments, those of skill in the art will recognize that changes may be made thereto without departing from the scope of the invention as set forth in the appended claims. For example, while three fences were disclosed as the preferred embodiment, the number of fences could readily be changed to be any number two or more. Any combination of two or more fences which are rotatably disposed about a common axis are within the scope of the below claimed invention.

We claim:

1. A dishwasher rack comprising:

a basket including a plurality of wires forming a bottom wall, a pair of side walls and a front and back wall, the bottom wall having a plurality of upwardly oriented tines connected to and extending from the bottom wall in a first area and further having an open area without upwardly oriented tines;

a first fence having an axle wire and a plurality of support wires, the axle wire being rotatably supported adjacent the bottom wall between a front position and a back position; a second fence having a connection wire and a plurality of support wires, the connection wire being rotatably connected to the axle wire such that the second fence may rotate about the axle wire between a front position and a back position, wherein the first fence and second fence may be rotated to the front position such that the support wires of the first fence and the support wires of the second fence form an upstanding array for supporting dishes, or alternatively, one or both of the first fence and second fence may be rotated to the back position.

2. The dishwashing rack according to claim 1, wherein the second fence includes a plurality of opposed hook elements for engaging the axle wire such that the second fence is rotatable about the axle wire.

3. The dishwashing rack according to claim 1, further comprising:

a plurality of clips for rotatably connecting the connection wire of the second fence to the axle wire of the first fence.

4. The dishwashing rack according to claim 1, wherein the connection wire has bent over opposite ends, the dishwashing rack further comprising:

a plurality of elongated clips, each of the elongated clips having a first end connected to the axle wire and a second end including an elongated socket for receiving one of the bent over opposite ends of the connection wire such that the connection wire extends in fixed 90° relationship from the elongated clip.

5. The dishwashing rack according to claim 1, further comprising:

a pair of wheel mounts mounted to the basket along opposite sides, each of the wheel mounts forming in combination with the basket a pocket inwardly directed toward the center of the basket, wherein the axle wire of the first fence has opposite ends which are captured within the sockets such that the first fence is rotatably secured to the basket.

6. The dishwashing rack according to claim 1, further comprising:

a third fence having a connection wire and a plurality of support wires being spaced along and extending from the connection wire, the connection wire of the third fence being rotatably connected to the axle wire, wherein the second fence and third fence are connected to different portions of the axle wire.

7. The dishwashing rack according to claim 1, further wherein the supports wires of the first fence are generally V shaped wires which are unevenly spaced along and extend from the axle wire and the support wires of the second fence are generally V-shaped wires which are unevenly spaced along and extend from the connection wire, and when both the first and second fences are in a front position, the support wires form an upstanding array of equally spaced wires and when the first fence is in a front position and the second fence in a back position, the support wires of the first fence form an upstanding array of unevenly spaced wires.

8. A dishwasher rack comprising:

a basket having a plurality of wires forming a bottom wall, a pair of side walls and a front and back wall, the bottom wall having a plurality of upwardly oriented tines connected to and extending from the bottom wall in a first area and further having an open area without upwardly oriented tines;

a first fence having a plurality of support wires, the first fence being rotatably supported adjacent the bottom wall between a front position and a back position;

a second fence having a plurality of support wires, the second fence being rotatably connected to the first such that the second fence may rotate about the first fence between a front position and a back position, wherein the first fence and second fence may be rotated to the front position such that the support wires of the first fence and the support wires of the second fence form an upstanding array for supporting dishes, or alternatively, one or both of the first fence and second fence may be rotated to the back position.

9. The dishwashing rack according to claim 8, wherein:

the first fence includes an axle wire connected to the support wires, the support wires being spaced along and generally perpendicular to the axle wire, the second fence including a connection wire connected to the support wires, the support wires being spaced along and generally perpendicular to the connection wire, and wherein the second fence includes a plurality of opposed hook elements for engaging the axle wire such that the second fence is rotatable about the axle wire.

10. The dishwashing rack according to claim 8, further comprising:

a plurality of clips for rotatably connecting the second fence to the first fence.

11. The dishwashing rack according to claim 8, wherein the first fence includes an axle wire connected to the support wires, the support wires being spaced along and generally perpendicular to the axle wire, the dishwashing rack further comprising:

a pair of wheel mounts mounted to the basket along opposite sides, each of the wheel mounts forming in combination with the basket a pocket inwardly directed toward the center of the basket, wherein the axle wire of the first fence has opposite ends which are captured within the sockets such that the first fence is rotatably secured to the basket.

12. The dishwashing rack according to claim 8, further comprising:

a third fence having a connection wire and a plurality of support wires being spaced along and extending from the connection wire, the connection wire of the third fence being rotatably connected to the axle wire, wherein the second fence and third fence are connected to different portions of the axle wire.

* * * * *